United States Patent [19]

Tabaroni et al.

[11] 4,156,336

[45] May 29, 1979

[54] MACHINE FOR MANUFACTURING, FILLING AND CONVEYING ENVELOPES

[75] Inventors: Roberto Tabaroni; Franco Aiuola, both of Bologna, Italy

[73] Assignee: Azionaria Costruzioni Macchine Automatiche A.C.M.A. S.p.A., Bologna, Italy

[21] Appl. No.: 855,502

[22] Filed: Nov. 28, 1977

[30] Foreign Application Priority Data

Dec. 13, 1976 [IT] Italy ..... 41701 A/76

[51] Int. Cl.[2] ..... B65B 43/02; B65B 43/12; B65B 43/30

[52] U.S. Cl. ..... 53/562; 53/570; 53/266 A; 53/386

[58] Field of Search ..... 53/183, 187, 266 A, 53/386

[56] References Cited

U.S. PATENT DOCUMENTS

| | | | |
|---|---|---|---|
| 2,957,284 | 10/1960 | Harker | 53/183 X |
| 3,340,679 | 9/1967 | Johnson | 53/187 X |

*Primary Examiner*—Travis S. McGehee
*Attorney, Agent, or Firm*—Guido Modiano; Albert Josif

[57] ABSTRACT

A machine for manufacturing, filling and conveying envelopes obtained from a heat sealable sheet material, comprising a first closed loop conveyor, a second closed loop conveyor the first and the second conveyors having drive means imparting a continuous motion of constant speed thereto a plurality of envelope forming and delivering sets arranged along an envelope accepting path portion of the first conveyor and in spaced relationship to each other and adapted selectively to deliver open envelopes to the first conveyor along the envelope receiving path portion thereof, the first conveyor having first gripper means carried thereon second gripper means on the second conveyor and arranged therealong in spaced relationship to each other, the second gripper means having a pair of gripper arms mounted on the second conveyor for oscillation about respective axes parallel to each other, thereby to allow the gripper arms to approach and move away from each other when the arms are oscillated to maintain the envelopes gripped by the second gripper means in stretched condition when the arms are oscillated in a position at a distance away from each other and alternatively in a position of smaller distance from each other, in which they partially crumple up laterally the gripped envelopes whereby the opening thereof is spread transversely, further conveyor means having mounted thereon devices for further spreading the envelopes, metering devices downstream of the further conveyor means for filling with produce the opened envelopes, and a welding device downstream of the metering devices.

8 Claims, 12 Drawing Figures

121
116
120
119
123
122
N
121
114
115
215
112
109a
113
109a
15a
88
91

MACHINE FOR MANUFACTURING, FILLING AND CONVEYING ENVELOPES

BACKGROUND OF THE INVENTION

This invention relates to a machine for manufacturing flat envelopes from a heat sealable material, and for filling, sealing and conveying such envelopes.

Past studies have led to the provision of machines wherein the formation of the envelopes, consecutively to one another along a heat sealable web folded up lengthwise, and the subsequent filling and sealing of the envelopes, are performed with an intermittent processing method owing to the fact that a majority of the members participating in such a formation perform a reciprocating motion. In these machines, which will be termed "reciprocating" for brevity, the main manipulations and handling steps on the heat sealable web, and accordingly on the envelopes obtained therefrom, are carried out with the web held stationary. A high product quality is achieved, thanks especially to the stability and reliability of the heat sealed seems thus obtained; however, the hourly output of the reciprocating machines is not so satisfactory, due to the slow rate of their envelope forming cycle.

Other machines, also provided by previous studies, process the heat sealable web and envelopes while moving or on-the-fly, and afford a higher production output, but at the expense of the resulting product quality, due to failure of the sealed seams.

The design is, moreover, such as to present the usual problem of interrupting the production cycle every time that the coil or roll of heat sealable web is exhausted and a fresh one is to be installed.

SUMMARY OF THE INVENTION

In the light of the above situation, it is a task of this invention to offer a solution to the technical problem of providing a machine for manufacturing flat envelopes from a heat sealable sheet material, and for the filling thereof, which ensures a high production rate of correctly formed envelopes.

Within the scope of that task, it is an object of this invention to eliminate the interruptions in the production cycle whenever a fresh coil of heat sealable web is to be installed to replace an exhausted one.

It is another object of the invention to make provision for adaptation to be particular size or format of the envelopes.

It is a further object of this invention to provide for a positive opening or spreading action of the envelopes prior to the introduction of products therein.

It is still another object of the invention to provide a machine which is easily adaptable to delivering the envelopes produced to successive collecting and/or packaging machines for those same envelopes.

According to the invention this task is fulfilled and these objects are achieved by a machine for manufacturing, filling and conveying flat envelopes obtained from a heat sealable sheet material, characterized in that it comprises, a first closed loop conveyor having an envelope accepting path portion and an envelope transferring path portion, a second closed loop conveyor having an envelope receiving path portion, an envelope processing path portion and an envelope transporting path portion, said envelope receiving path portion of said second conveyor being arranged in side by side relationship with said envelope transferring path portion of said first conveyor, said first and second conveyors having drive means imparting a continuous motion of constant speed thereto, said envelope receiving path portion of said first conveyor having a substantially greater extension than that of said envelope transferring path portion, a plurality of envelope forming and delivering sets arranged along said envelope accepting path portion of said first conveyor and in spaced relationship to each other and adapted selectively to deliver open envelopes to said first conveyor along said envelope receiving path portion thereof, said first conveyor having first gripper means carried thereon and arranged therealong in spaced relationship to each other, first cam means arranged in preestablished positions along said first conveyor for controlling the gripping and releasing action of said first gripper means in respect of said envelopes while moving past said first cam means, thereby to grip one envelope at a time when a first gripper means is carried by said first conveyor past one said envelope forming set, second gripper means on said second conveyor and arranged therealong in spaced relationship to each other, second stationary cam means arranged around said second conveyor means to control the gripping and releasing action of said second gripping means thereby to cause each said second gripper means to grip one said envelopes at a time when said second gripper means are carried by said second conveyor along said envelope receiving path portion thereof past said envelope transferring path portion of said first conveyor, said second gripper means having a pair of gripper arms mounted on said second conveyor for oscillation about respective axes parallel to each other, thereby to allow said gripper arms to approach and move away from each other when said arms are oscillated, third stationary cam means arranged around said second conveyor for oscillating said gripper arms thereby to maintain said envelopes gripped by said second gripper means in stretched condition when said arms are oscillated in a position at a distance away from each other and alternatively in a position of smaller distance from each other, in which they partially crumple up laterally the gripped envelopes whereby the opening thereof is spread transversely, further conveyor means having a path portion thereof arranged near and coextensive with part of said envelope processing path portion of said second conveyor, said further conveyor means having mounted thereon devices for further spreading the envelopes while the latter are carried by said second conveyor along said part of envelope processing path portion thereof in which said third cam means maintain said gripper arms in said position of smaller distance thereof and in which the envelope opening is transversely spread, metering devices downstream of said further conveyor means for filling with produce, the opened envelopes, a welding device close to a length of said envelope processing path portion of said second conveyor downstream of said metering devices, along said length of said processing path portion of said second conveyor means, said third stationary cam means maintaining said gripper arms in a position of maximum distance in which said envelopes are stretched allowing thereby the opening of said envelopes to be closed and sealed by said welding device while the envelopes are conveyed past said welding device, said second cam means causing said second gripper means to release said envelopes while said envelopes are conveyed along said envelope transposing path portion of said second conveyor, thereby allowing said envelopes to be transferred for further handling thereof.

BRIEF DESCRIPTION OF THE DRAWINGS

Further features and advantages of the invention will become apparent from the following description of a preferred but not exclusive embodiment of the instant machine, illustrated by way of example only in the accompanying drawings where.

DESCRIPTION OF THE PREFERRED EMBODIMENTS

Figure 1:
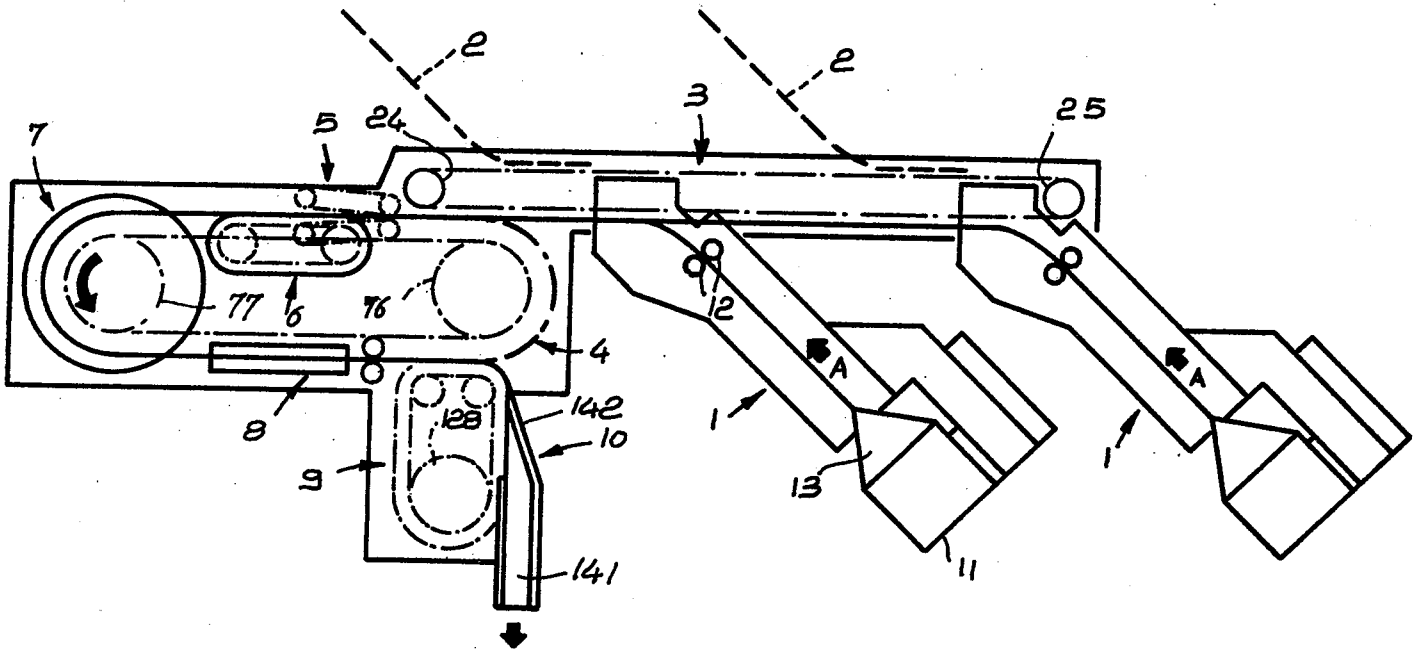
FIG. 1 shows schematically, in plan view, a machine according to this invention.

With reference in particular to FIG. 1, the machine as a whole will be discussed first, leaving aside the details of its construction, which will be discussed hereinafter. The machine comprises at least two partially known flat envelope forming sets 1; any additional forming sets are denoted with the numeral 2 and are shown in dotted lines. The various forming sets are arranged along the path of a first conveyor 3, of closed loop configuration and driven with constant motion. The conveyor 3 receives envelopes alternately from one and the other of the forming sets in operation, and passes them to a second conveyor 4, also of closed loop configuration and driven with constant motion. Along the conveyor 4, devices 5 and 6 open and spread apart the envelopes, which are then filled by one or more delivery devices with metered amounts of products; the drawing shows just one such known rotating metering device 7. The envelope mouth is then sealed by a respective device 8. Finally, the envelopes are passed from the conveyor 4 to the final conveyor 9, which releases them at 10 to an output station.

The construction and operation of a partially known forming set 1 or 2 will now be described with reference to FIGS. 1 to 4.

A coil 11 of a heat sealable web, carried pivotally about a horizontal axis transverse to the feed direction of the web, is uncoiled by the pair of vertical feed rollers 12 entraining and advancing the web 15. As it leaves the coil, the web is engaged by the stationary folder 13. The folder 13 is made of a triangular plate having one of his sides parallel to the axis of the coil 11. The folder 13 is inclined with respect to the direction of the feed of the web, so that its vertex is at a lower level than the level of the side opposite to the vertex and parallel to the coil axis. Thereby with cooperation of guiding rollers, not shown, the web is first folded partially about the lateral sides of the triangular plate and at the triangle vertex it receives a fold with the aid of not shown rollers along its longitudinal axis, the fold extending downwardly, while the longitudinal or lengthwise edges of the web are adjacently located upwardly. As it moves stepwise in the direction A, the thus folded web is positioned between two known vertical seam welders, not shown, located stationary upstream of the rollers 12, and which effect thereon a vertical sealed seam 14, thereby an upwardly open flat envelope 15 is defined between two contiguous vertical seams. Immediately downstream of the rollers 12, per se known scissors 16 are provided stationary which, like side welders, become operative during the web stops and effect the cutting at the centerline of the previously sealed seam 14, thus causing one respective envelope to be detached. In a known manner, both the rollers 12 and the scissors 16 are driven by respective cyclical actuators connected to a respective rotating shaft 17 (FIG. 2); accordingly, the symbolic curves or graphs B,C and D of FIG. 4 show symbolically the operating phases of the rollers and scissors during the time T, which corresponds to one cycle of the respective forming set 1 or 2, i.e. corresponding to one revolution of the shaft 17. The segments B1 and B3 of the curve B are representative of respective conditions wherein the rollers 12 do not rotate, while the segment B2 is representative of the roller rotation in the opposite direction to the direction of advance or forward motion of the heat sealable web. The rotation according to arrows E (FIG. 3) corresponds to said direction of advance and is represented by the segment B4 in the graph of FIG. 4. The segments C2 and C4 of the curve C, indicate respectively that the rollers 12 are disconnected, or in other words moved away from each other to a sufficient extent, while they rotate in the opposite direction to the web direction of advance, and that they are instead coupled or connected together as the web advances; the segments C1 and C3 are thus illustrative of the phases whereat the rollers are on the point of becoming disconnected and respectively of becoming connected together. The curve D, with its segments D1,D2 and D3, illustrates respectively the closing, opening and permanence in the open condition of the scissors 16, the cutting of the web taking place while the rollers 12 are stationary and coupled together, the web to be cut being clamped therebetween.

Now, according to the invention, located between every two forming sets 1 or 2 and the conveyor 3, are a vertical roller assembly comprising: the positioning and transferring rollers 18 and 19, forming a first pair for accelerating the envelope cut off from the web, and the second delivery roller pair 20, located downstream of the former and inserting the envelope in a corresponding gripper 21 of the first conveyor 3. The conveyor 3 (refer also to FIG. 5) comprises a pair of chains 22, in a closed loop superimposed configuration, which slidably engage in respective horizontal guides 23 arranged one above the other and mesh with a pair of driving sprockets 24, and with a pair of idle return sprockets 25, both having vertical axes of rotation. The frame 26 of each gripper 21 is mounted between the two chains 22 by means of a pair of respective pivot pins 27 and 28 and are entrained therewith. The frames 26 are spaced apart at regular intervals along the two chain strands. Through a pair of bevel gears, not shown, the sprockets 24 are driven with a constant and continuous rotary motion by a driveshaft 29 which performs one revolution through the time t (FIG. 4); as the shaft 29 completes one revolution, the chains 22 move forward in the direction of arrow F by one pitch distance, i.e. the distance existing between two successive frames 26. The time t is a submultiple of a time T mentioned above; the time T, in fact, exceeds the time t by as many times as is the number of the envelope forming sets which, at any one moment, are selected to become operative; in particular, assuming that only two of the sets 1 and 2 are at all times operative, T is equal to twice t (FIG. 4). In this manner, each gripper 21 upon coming close to the sprocket 24, that is downstream of all other envelope forming sets, carries an envelope.

Figure 2:
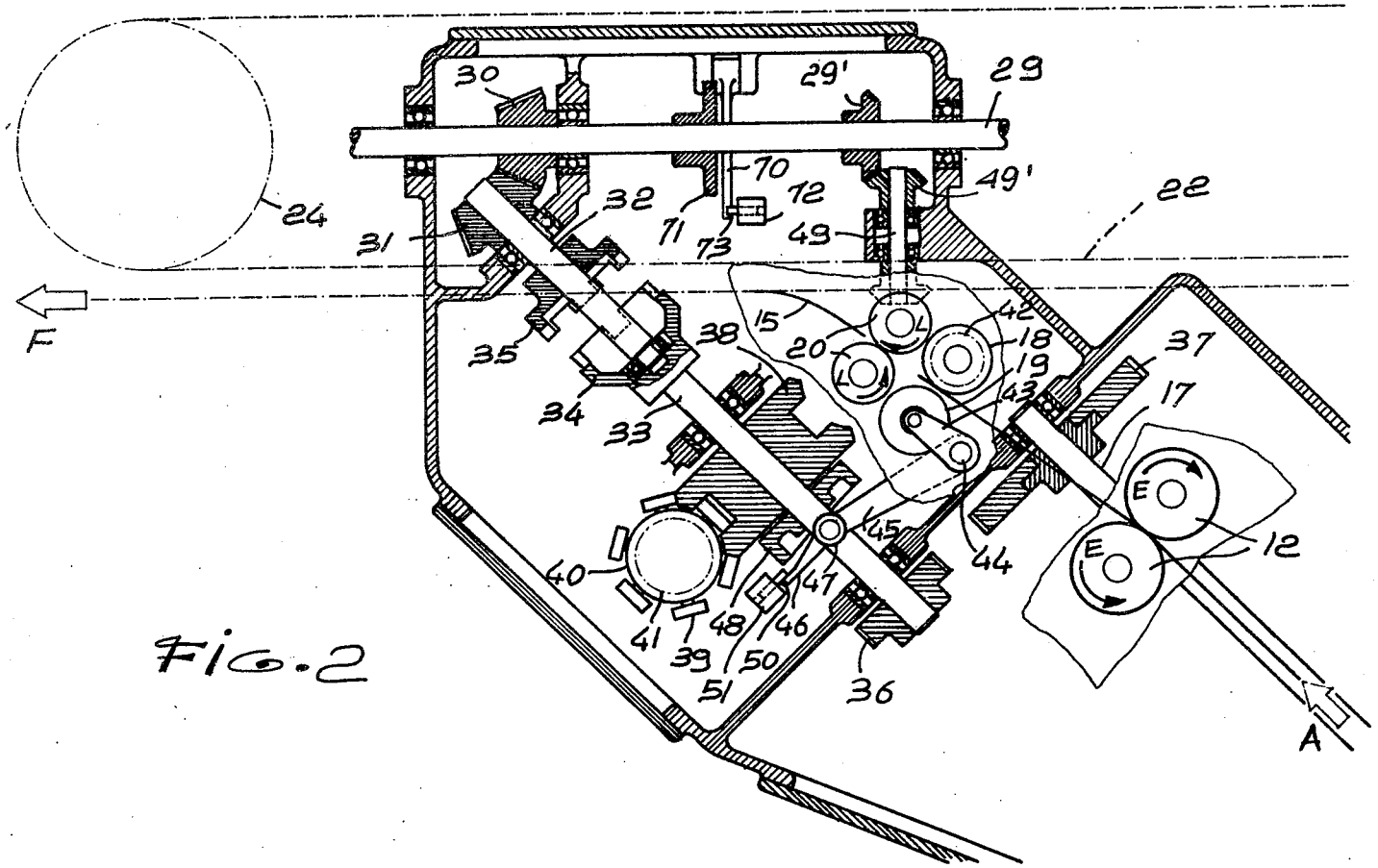
FIG. 2 is essentially a horizontal sectional view showing the drive train to one of said envelope forming sets.

Between the shaft 29 and shaft 17 of each envelope forming set, there is interposed a transmission group, as will be explained hereinafter. Through the bevel gears 30, 31, the shaft 29 drives at its own angular velocity the shaft 32, aligned wherewith is the shaft 33. On the shaft 33 is rigidly mounted the member 34 of a claw clutch coupling, the other member 35 whereof is axially slidable on but not rotatable about the shaft 32. In order to maintain the phase or timing of the shaft 29 to the shaft 33, the claws of the clutch are such that the member 35 has just one angular position of engagement with the member 34. When the related envelope forming set is operative, the member 35 is engaged with the member 34, i.e. contrary to what is shown in FIG. 2. How the closing or engagement of the member 35 with the member 34, and conversely the opening thereof, is obtained, will be explained hereinafter. The wheel 36 is keyed to the shaft 33 and, with the interposition of a gear wheel not shown, drives the wheel 37 of the shaft 17. in the embodiment shown in the drawing, the drive ratio of the shaft 33 (and accordingly shaft 29) to the shaft 17 is 2:1, thereby said relation $T = 2t$ is observed; at any rate, by exchanging one of the three gear wheels mentioned above, the desired drive ratio or desired T/t ratio is obtained.

To the shaft 33, there is also keyed a wheel 38 of a type also known as "Z" gear. This type of wheel has spiral patterned grooves extending from one side of the wheel to the other. The details of such type of "Z" gear are more fully described in the Swiss Pat. No. 549,790 of the same applicant. With continuous meshing, rollers 39, carried by a wheel 40, engage successively with the grooves of the wheel 38, and transmit an intermittent rotatory motion to the wheel 40 from the continuously rotating wheel 38. The wheel 40 is keyed to a vertical shaft whereto a wheel 41 is also rigidly mounted at a vertical distance from wheel 40. The wheel 41 drives, through a chain not shown, the wheel 42 rigid with the roller 18. By virtue of the wheel 38, the roller 18 has its law of motion represented symbolically by the curve G: the segments G1,G2,G3 and G4 of the curve G correspond to zero rotation, accelerated rotation, constant velocity rotation, and decelerated rotation of the roller 18, respectively. The roller 19 is mounted to a swingable lever member 43 which oscillates about a vertical axis 44; from that swingable member 43 there extend an arm 45 and lug 46. By virtue of a spring, not shown, the roller 47 of the arm 45 is effective to maintain the contact with the cyclical cam 48, keyed on the shaft 33. In accordance with the symbolic segments H1,H2,H3 and H4 of the curve H in FIG. 4, the swingable member 43, the position of which is controlled by the cam 48, determines the approaching, the full engagement, the moving apart and full disengagement, respectively of the roller 19 with respect to the roller 18. As it may be noted, during the time T, the roller 19 only engages once with the roller 18, such as to cause one gear wheel thereof (not shown) to mesh with a corresponding wheel (not shown) of the roller 19; in this manner, the rollers 18 and 19 are driven to rotate in the direction of arrow I and achieve, at the segment G3 of the curve G, a constant peripheral speed equal to that of the rollers 20. The rollers 20 are at all times coupled together and rotate permanently in the direction of arrow L: in fact, through bevel gear pairs 29', 49' shown in FIG. 2 a shaft 49 is driven by the shaft 29 and drives in turn one of the rollers 20, which drives in turn the other roller. The peripheral speed of the rollers 20 equal to the speeds of the frames 26 of the grippers 21 carried by the chain 22. In order to prevent the roller 19 from engaging more than one the roller 18 during a time T, a stop 50 is provided which takes the active position shown in FIG. 2 under the action of an electromagnet 51 actuated by a cyclical cam mounted to the shaft 17 and not shown. The electromagnet 51 holds the stop 50 in an active position for the time and with the phase, as indicated by the range M of FIG. 4, and against such a stop abuts the lug 46 of the moving member 33, which is therefore held in the position corresponding to the disengagement of the roller 19, and does not follow the profile of the cam 48 as indicated by a second symbolic curve H (it being less significant, this curve is shown in dotted lines).

Figure 3:
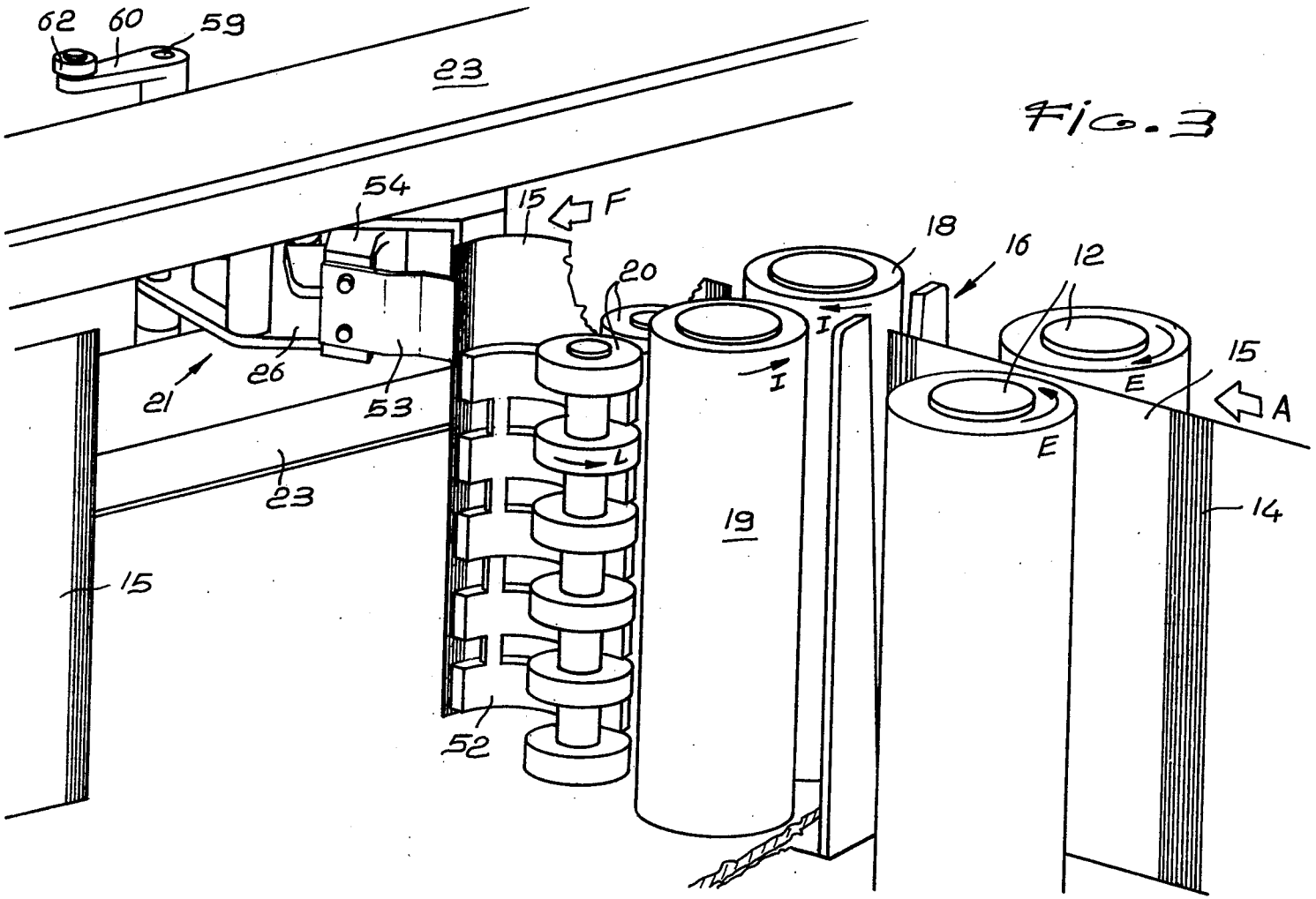
FIG. 3 is a perspective view of one of said roller assemblies.
Figure 4:
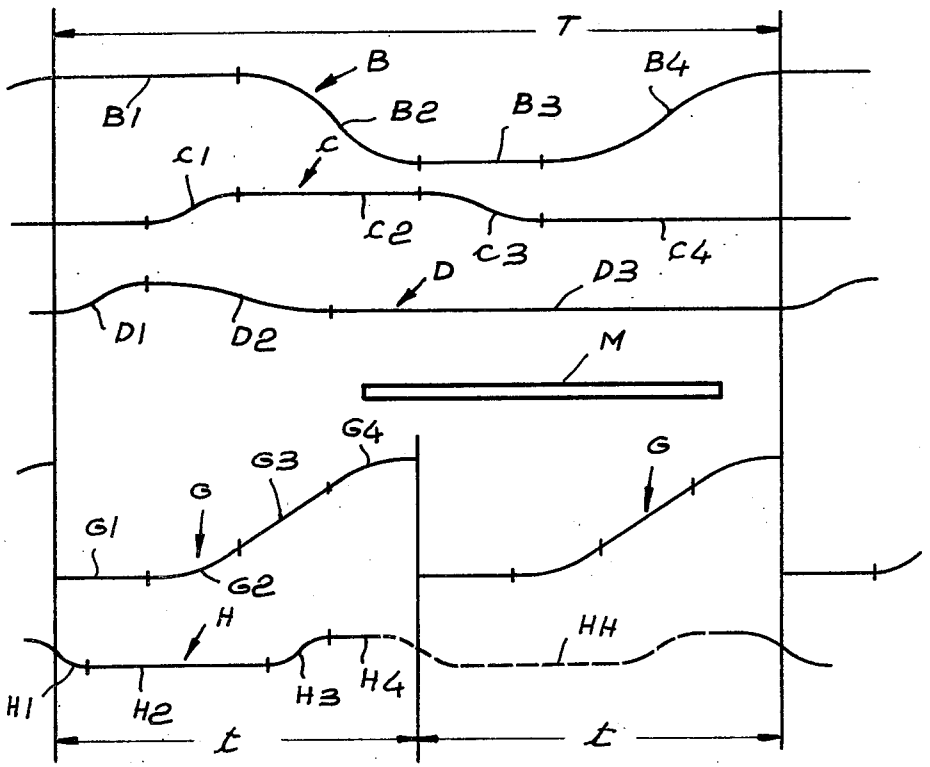
FIG. 4 shows, in graph form, the relationship between the operative phases of one of said forming sets and the respective one of said roller assemblies.

Considering that in FIG. 3 the actual distance between the roller pair 12 and the pair 18,19 appears reduced for reasons of drawing space, the steps of formation of an envelope and insertion of the same in the conveyor 3 will now be summarized. As the rollers 12 are mutually engaged and rotate in the direction of arrow E, the scissors 16 are opened and the rollers 18 and 19 are disengaged; an envelope not yet severed from the web is then positioned with its downstream or leading edge side between the rollers 18 and 19 and, with its upstream or trailing edge side, between the two members of the scissors 16. While the rollers 18 and 19 engage with each other but without rotating, and the rollers 12 have ceased to rotate but are still engaged with each other, the scissors 16 effects the separation of the envelope from the web. The rollers 18 and 19, coupled together, begin to rotate in the direction of arrow I and, as their peripheral speed reaches the speed of the rollers 20, the envelope accelerated thereby enters the nip of the rollers 20, which with the aid of the stationary guides 52, introduce the downstream or leading edge side of that same envelope between the open claws of a gripper 21 of the conveyor 3, the gripper having zero speed with respect to said side of the envelope.

As regards the clutch 34, 35, its opening or disactivation or in other words the sliding of the member 35 until it separates from the member 34, is effected when the coil 11 of the respective set is being exhausted. The means sensing the exhaustion of the coils of the various forming sets are coordinated to one another through a storage programmer which controls the alternation in operation of those same sets: in this manner, when a clutch 34,35 is opened and the introduction of envelopes in the conveyor 3 by the respective forming set is discontinued, the clutch of a forming set, inactive until then, must be closed sufficiently in advance or retard as to cause the envelopes supplied by the set freshly put in operation to fill the vacancies which would otherwise be left on the conveyor 3 by the set which has just exhausted its coil.

Figure 5:
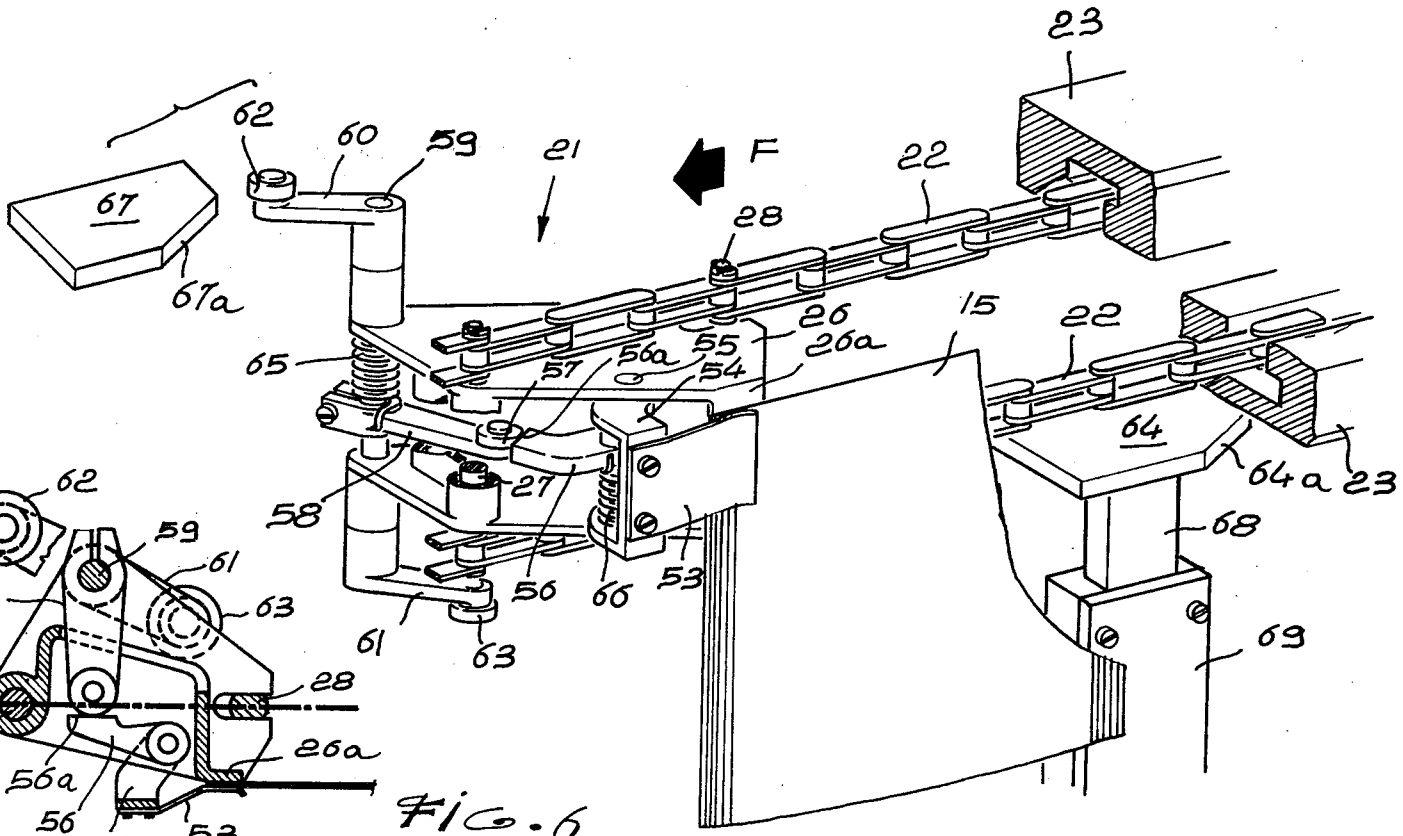
FIGS. 5 and 6 are perspective and horizontal sectional views respectively of a gripper in the first of said conveyors.
Figure 6:
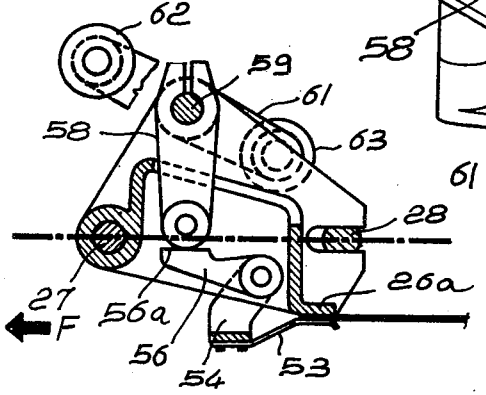

With reference in particular to FIGS. 5 and 6, the fixed jaw of each gripper 21 comprises an area 26*a* of the respective frame 26, and the free end of a resiliently flexible clip-like reed 53, constituting the movable jaw of the gripper cooperates therwith in its clamping action. The other end of the reed or clip 53 is attached to the crossmember of a yoke 54, located downstream with respect to the area 26*a*. At 55, the yoke 54 is mounted on the frame 26 for oscillation about a vertical axis; radial to such an axis and rigid with the yoke, is an arm 56, which terminates with a mating edge 56*a* engaging a roller 57 carried by an arm 58. The arm 58 is rigid with a vertical pivot pin 59, mounted for oscillation onto the frame 26. Above and below the frame 26, respective cranks 60 and 61 are mounted rigidly on the pin 59. In respect of their circumferential paths about the pivot 59 said cranks are substantially diametrically opposed and terminate in respective rollers 62 or 63.

While a gripper 21 is receiving an envelope 15, the jaw or clip 53 is on the point of closing against the area 26*a*. The closing of the gripper is actuated by a selective cam 64, located at the confluence with the conveyor 3 of the forming set 1 or 2 which supplied the envelope. With the active edge 64*a* of the cam 64 engages in fact the roller 63 of the crank 61 which, with reference to FIGS. 5 and 6, consequently rotates clockwise against a torque spring 65 to take the position shown in such figures. With such a rotation of the crank 61, pivot pin 59, and arm 58, the roller 57 of the latter, by acting on the arm 56, causes it to rotate in an anticlockwise direction against the bias of the torque spring 66. On completion of the rotational movement, the roller 57 is pointed against the mating edge 56*a* of the arm 56, and the reed 53 is pressed against the area 26*a* of the frame 26. Such a closed position of the gripper 21 is per se stable owing indeed to the fact that the roller 57 abuts against the mating edge 56*a*; it should be noted that when the gripper is closed, the arm 58 is substantially perpendicular to the arm 56, as clearly shown only in FIG. 6 so that the acting and reacting forces generated by the springs 65,66 and 53 are in a condition of stable equilibrium. The springs 65 and 66 act between the frame 26 and arm 58, and respectively, the arm 56. As an envelope delivered by a gripper 21 is passed to a gripper in the conveyor 4, as will be explained hereinafter, the reed or clip 53 is brought to an opened position, the roller 62 engaging the active edge 67*a*, of the cam 67, which is stationary near the wheel 24. The cam 67 causes the crank 60 and arm 58 to rotate anticlockwise, until the arm abuts on a detent provided by the frame 26 and not shown, and stays there by virtue of the spring 65; the spring 66 holds instead the arm 56 resting against the roller 57, which has moved away from the mating edge 56*a*. The gripper 21 opened position is, therefore, also an inherently stable one.

As mentioned above, the cams 64, one for each envelope forming set, are selective cams: they must in fact cause the closing of a gripper only when the latter, on reaching a forming set, receives a respective envelope therefrom. Each cam 64 is thus rigid with the top of a stem 68, slidable in the vertical guide 69, and is only operative or active after reaching its top stroke end (FIG. 5); the cam is only active once per cycle T of the corresponding forming set. The alternate upward strokes and downward strokes of the cam 64 are determined by a rocker 70 (FIG. 2), driven by a cyclical cam 71 which is keyed to the shaft 29. An electromagnet 72, controlled by a cyclic cam from the shaft 17, is effective to bring a stop 73 into an active or operative position, in which the stop holds the rocker 70 in the position corresponding to the bottom stroke end of the cam 66. The stop 73, however, is active every time that the corresponding forming set is, for any reason, out of operation.

The rocker 70, the stop 73, the cam 71 and the electromagnet 72 operate in a somewhat similar manner as the previously described rocker arm 47, the stop 50, cam 48 and the electromagnet 51 except for the movement of rocker 70, which occurs transverse to the axis of cam 71, whereas rocker arm 45 is shifted with its roller 47 in the axial direction of cam 48.

Figure 7:
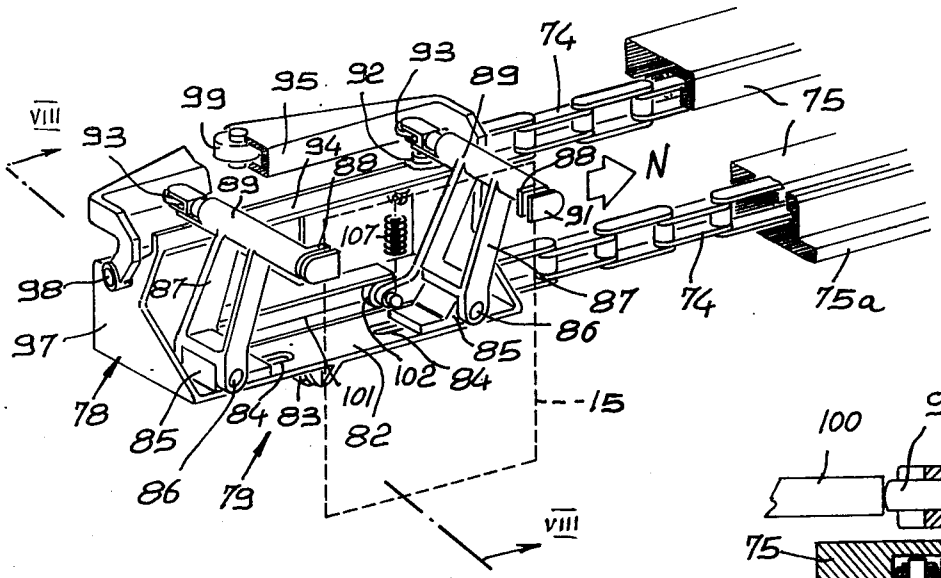
FIGS. 7 and 8 show respectively in perspective and in vertical cross-section according to line VIII—VIII of FIG. 7 a pair of grippers in the second of the cited conveyors.
Figure 8:
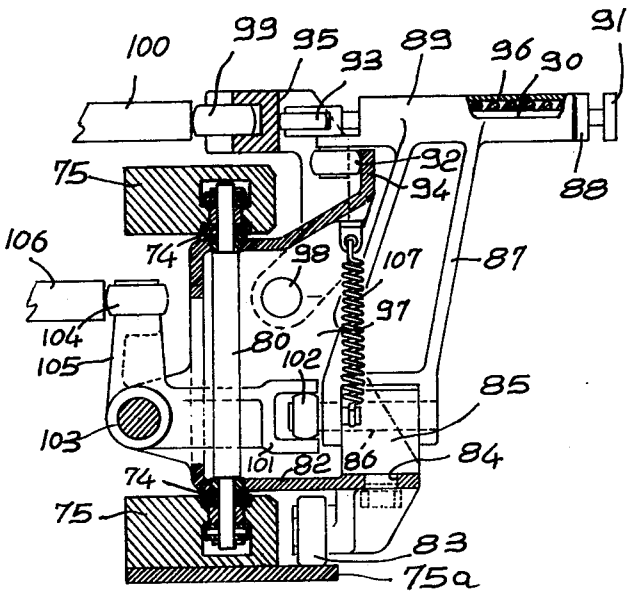
Figure 9:
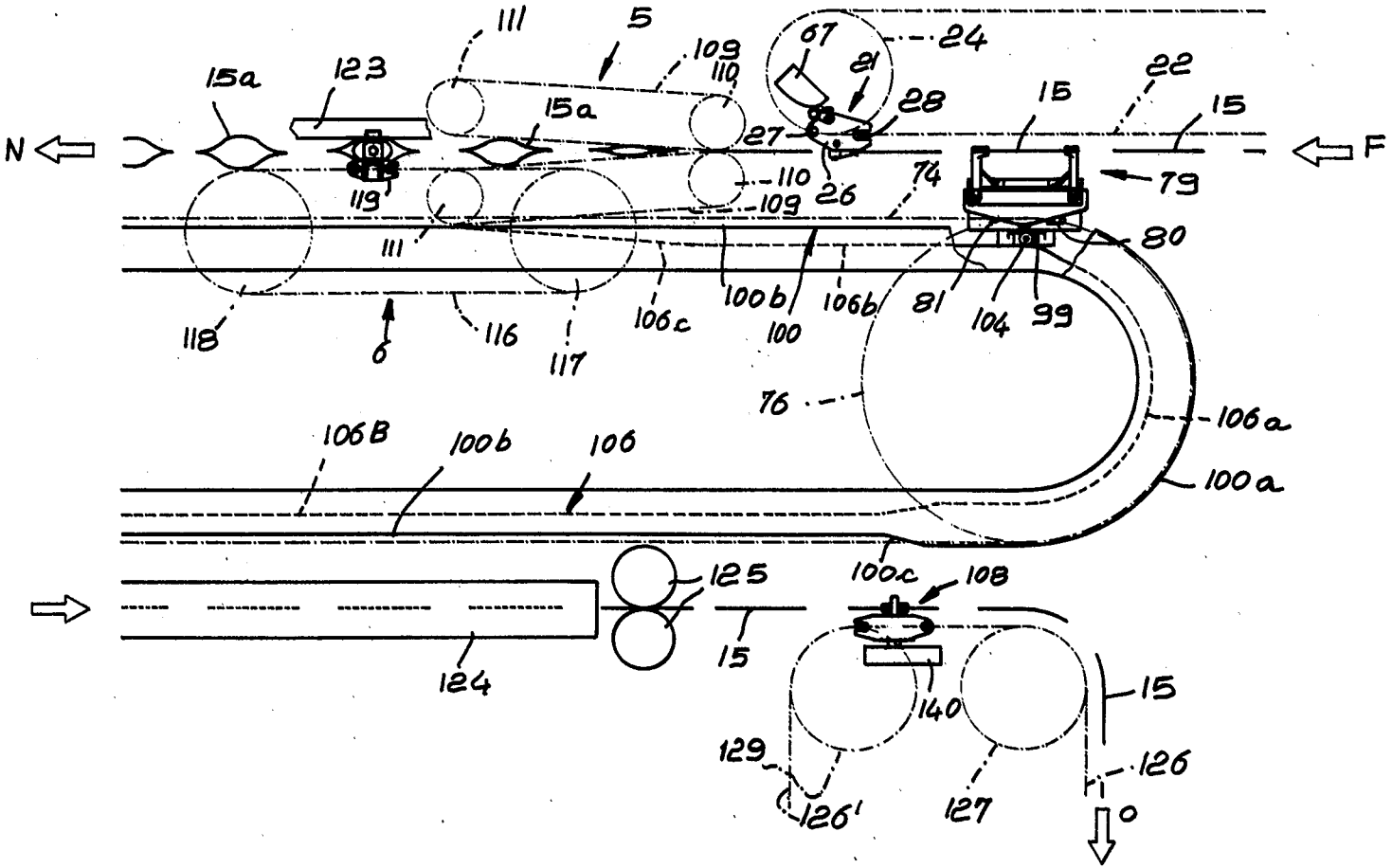
FIG. 9 is a schematic plan view of part of the instant machine.

With reference now to FIGS. 7, 8 and 9, the conveyor 4 comprises a pair of superimposed chains 74 of closed loop configuration which engages in the guides 75 and mesh with the twin driving sprocket 76 and idle return sprocket 77 (FIG. 1); the chains 74 run in the direction of arrow N at a speed equal to the speed of the chains 22 of the conveyor 3. The initial portion of the chains 74, i.e. the one leaving the sprockets 76, extends parallel to and side by side with the final portion of the chains 22, i.e. the one approaching the sprochet 24, side by side therewith. Along the chains 74, and at regular intervals, there are distributed secured thereto frames 78 for respective gripper pairs 79, the pitch distance between the frames 78 being equal to the pitch distance between the frames 26 on the chains 22. Each frame 78 is mounted between the two chains 74 by means of vertical pins 80. The base 82 of the frame 78 is supported, through the roller 83, by the rail 75*a* of the lower guide 75. Two slots 84 are cut off the base 82, which extend parallel to the chains 74. Depending on the width of the envelopes 15, there are fastened adjustable along the two slots respective supports 85. Through a pin 86, laying horizontal and transversally to the chains 74, a respective arm 87 is mounted for oscillation on each support 85. The two arms 87 are formed at their tops and outwardly with respective fixed jaws 88 and define a tubular guide 89 as well, wherethrough the stem 90 of a respective movable jaw 91 is slidable, the guide and stem being parallel to the pins 86. At the opposite end with respect to the jaws 88 and 91, i.e. at the end towards the inside of the conveyor 4, the guide 89 and stem 90 carry respective rollers 92 and 93. The two rollers 92 engage with the ledge 94 of the frame 78, whereas the rollers 93 cooperate with a sort of rail 95 by virtue of a pushing spring 96 acting between the stem 90 and guide 89, respectively, and tending to hold the jaw 91 pressed against its respective jaw 88. The ledge 94 and rail 95 extend horizontally, lengthwise with respect to the chains 74, the rail being further carried by the sides 97 of the frame 78, and being mounted thereon at 98 for oscillation about a longitudinal axis. Owing to the action of said springs 96, a roller 99 pivotally mounted on the rail 95 is held against a cam 100 controlling the closing and opening of the gripper jaws 91. With a rail 101, there is positively engaged a roller 102 of one and respectively the other arm 87. The rail 101, which extends longitudinally, is mounted on the frame 78 for oscillation about a longitudinal axis 103. The roller 104 of an arm 105 of the rail 101 is held in engagement with a cam 106 for mutually approaching and moving away of the arm pair 87. The engagement of the roller 104 with the cam 106 is controlled by the tension springs 107 acting between the frame 78 and its related arms 87.

From the foregoing it will be understood that when the rail 101 is moved upwardly due to the angular movement imparted by the cam 106 to the arm 105 as the frame 78 is entrained by the chain 74, the arms 87, are rotated in opposite directions about pivots 86 to increase the distance between jaws 91. The opposite occurs, when rail 101 is downwardly moved by the action of cam 106.

With reference to FIG. 9, the profile of the stationary cams 100 and 106, extending along the path of the chains 74, will be discussed. All around the wheel 76, the cams 100 and 106 have respective portions 100*a* and 106*a*, whereto there corresponds the opening of the jaws 91 with respect to the fixed or stationary jaws 88 as well as the moving apart or spreading of the arms 87 of each gripper pair 79. In this manner, the grippers of each pair 79, shortly before leaving the wheel 76, are brought at the sides of a respective envelope 15 entrained by a gripper 21 of the first conveyor. Approximately at the exit from the wheel 76, the arms 87 approach each other for the first time, thereafter the jaw pair 91 closes against the stationary jaw pair 88: in fact, the two cams 106 and 100 have their portions 106*b* and 100*b* and respectively 106*a* and 100*a* parallel to the chains 74 but at different distances therefrom and the section which connects the portions 106*a* with the portion 106*b* is arranged slightly in advance with respect to the section which connects portion 100*a* to portion 100*b*. It should be noted that the portion 100*b* after leaving sprocket wheel 76 in direction N and after passing around idle wheel 77 (FIG. 1) extends up to the section 100*c* which provides connection with its portion 100*a*, i.e. up to the moment when the gripper pair 79 opens to pass an envelope to a gripper 108 of the final conveyor 9. The jaws 91 and 88 clamp an envelope 15 at its respective sides and slightly below its mouth 215, while the jaw 53 of a gripper 21 had previously clamped at its side downstream of or at its mouth. After the gripper 21 at the cam 67 has been opened, the envelope is completely passed to the gripper pair 79, the arms 87 whereof, slightly afterwards, are progressively urged by the portion 106*c* of the cam 106 to move still closer to each other. The maximum degree of approach is achieved by the arms 87 at the termination of the portion 106*c* and is then maintained until the envelopes have passed under the metering device 7 (FIG. 1). Upstream of the welding set 8 (FIG. 1), the mouth of the envelope is stretched owing to the fact that the arms 87 return to their most distant position determined by the portion 106*b* of the cam 106. For the sake of clarity, at the welding set 8, the related portion of the cam 106 is denoted with the symbolic reference numeral 106B which acts on the arms 87 in the same way as the portion 106*b*.

Figure 10:
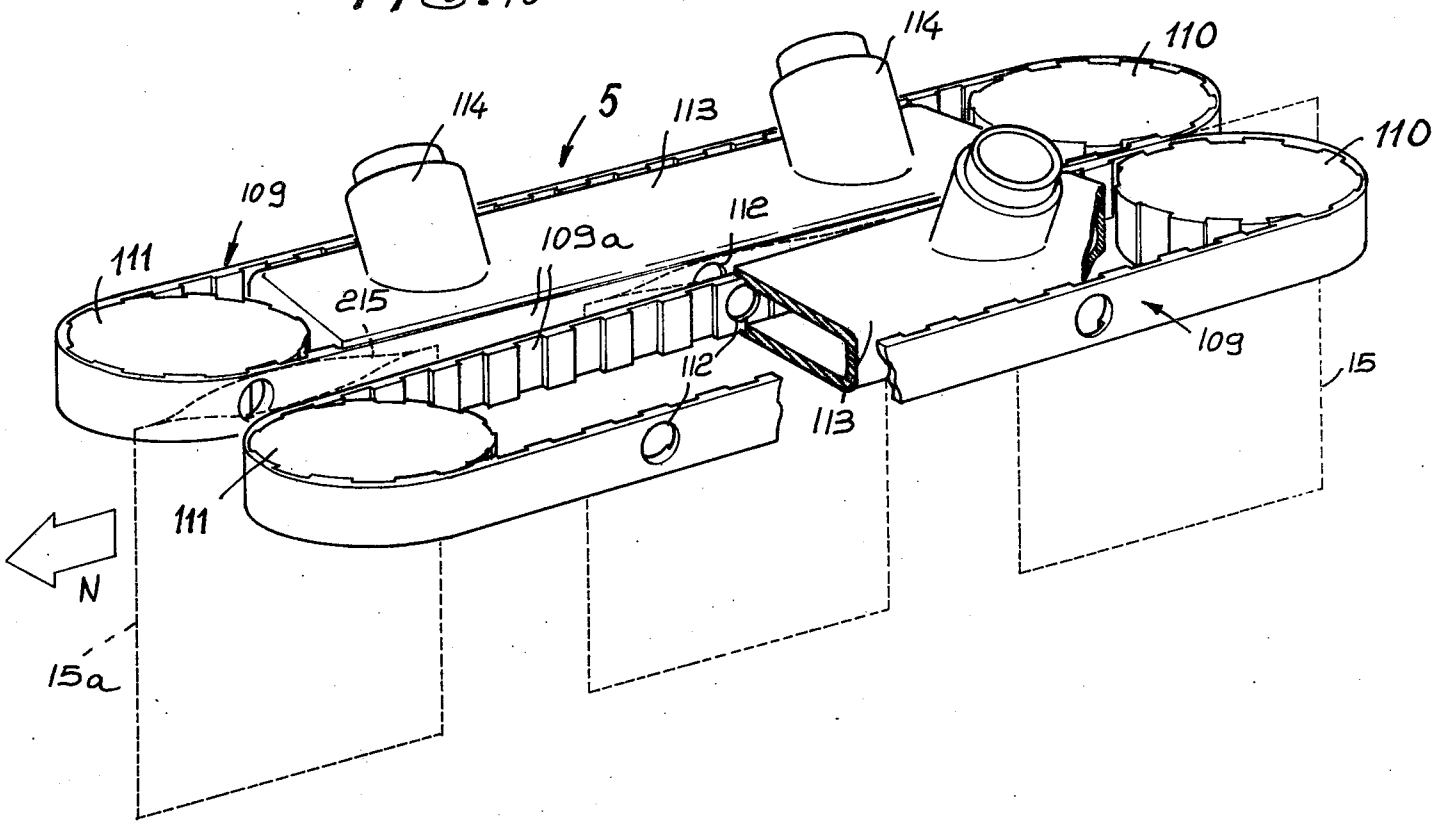
FIGS. 10 and 11 show in perspective representations details of the cited envelope opening and spreading devices.
Figure 11:
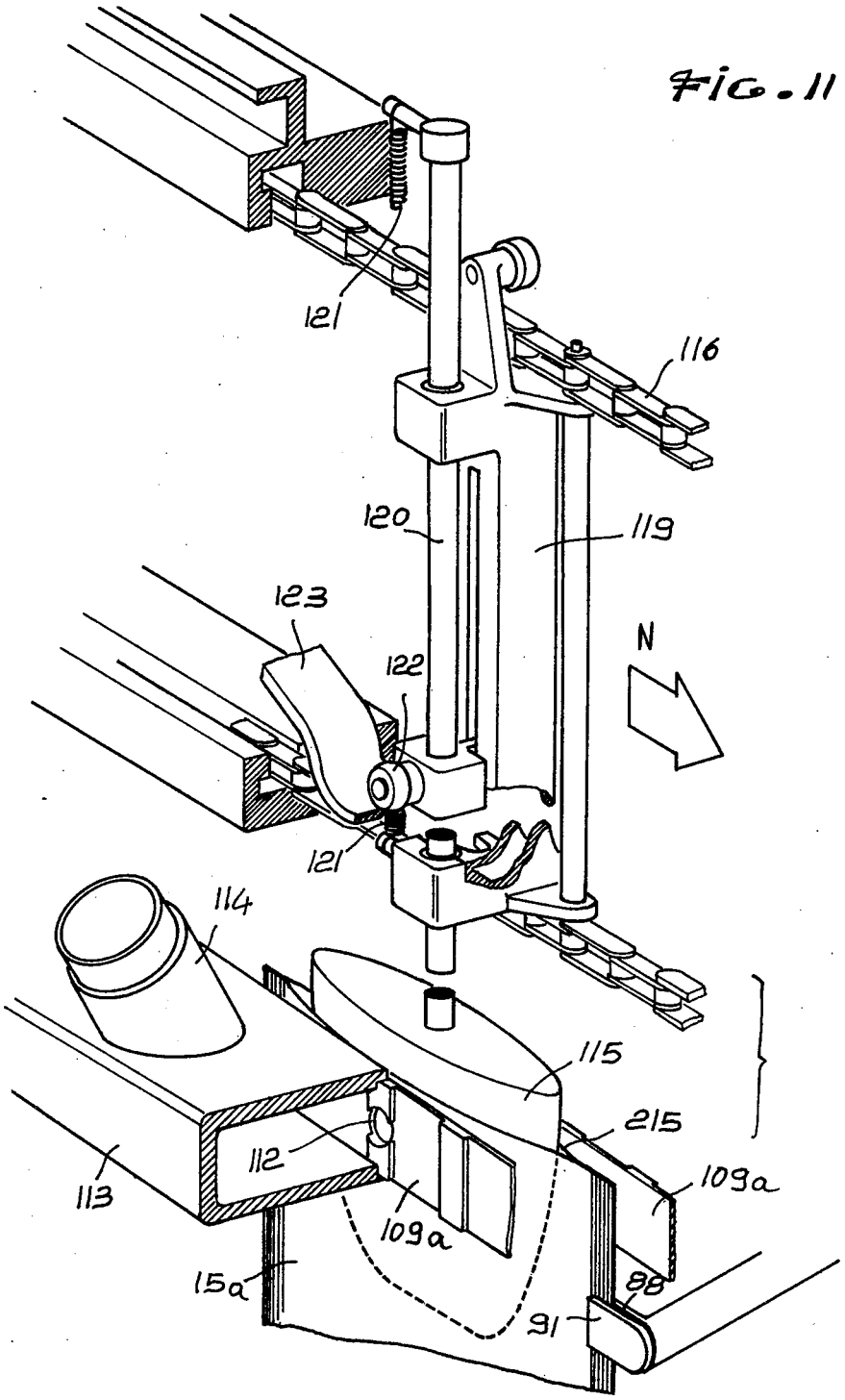

The progressive mutually approaching movement of the arms 87, corresponding to the portion 106*c* of the cam 106, facilitates the opening of the mouth 215 of the envelope, as actuated by the device 5 (FIGS. 9, 10 and 11); in this envelope opening and spreading phase, the envelopes are denoted with 15*a*. The device 5, arranged immediately above the chains 74, comprises a pair of belts 109 of closed loop configuration and formed with internal teeth for engaging respective driving wheels 110 and idle wheels 111. The portions 109*a* of the two belts, facing each other, run essentially in the direction of arrow N on one and respectively the other side of the path followed by the envelopes entrained by the grippers 79, and are moving with constant motion substantially at the same speed as the chains 74, and diverge progressively in the direction of motion. The belts are formed with through holes 112 which are arranged along the same at a pitch distance from one another virtually equal to that of the grippers 79. At the portion 109*a*, each belt 109 runs over the mouth of a respective chest 113, arranged stationary inside the run of that same belt. Through fittings 114, each chest 113 is connected to a high capacity suction or vacuum set. It thus happens that, since the holes 112 in the portions 109*a* of the belts move along with the envelopes carried by the grippers 79, the top of each of the two faces of the envelope is caused to adhere by suction to such respective portions of the belts. Owing to the progressive divergence of said portions 109*a*, the mouth 215 of an envelope, adhering thereto, is caused to open, since this is aided also by the progressive mutual approaching of the arms 87 of the grippers 79 arranged below the belt 109 and by the inflow of air from stationary overhead blowers, not shown. Before the envelopes leave the belts 109, a respective punch 115 (FIG. 11) is caused to be lowered thereinto, through the mouth 215. The punch 115 is suitably shaped to confer a spreaded shape also to the envelope body. Thereby the latter is made ready to receive metered amounts of products. A pair of closed loop chains 116, driven by the sprocket 117 (FIGS. 9 and 11) and run around the idler 118, have respective portions which move along the path of the grippers 79, overlying them, partly overlapping the belts 109 and partly downstream thereof. Such portions move in the direction of arrow N at the same speed as the grippers 79. At regular pitch intervals, equal to those of the grippers 79, frames 119 are mounted on the chains 116. On each frame, there is guided for vertical sliding movement a stem 120, at the bottom whereof a punch 115 is mounted rigidly therewith. The tension spring 121 (of which only a section is shown in FIG. 11) intervening between the frame and stem urges the latter downwards, thereby holding the roller 122 of the stem 120 constantly against the cam 123, which is located along the path of the chains 166', and which, downstream of the wheel 117, allows the punches 115 to be lowered into the envelopes 15*a*, and which upstream of the wheel 118, causes the latter alternatively to raise and to be withdrawn from the envelopes.

Figure 12:
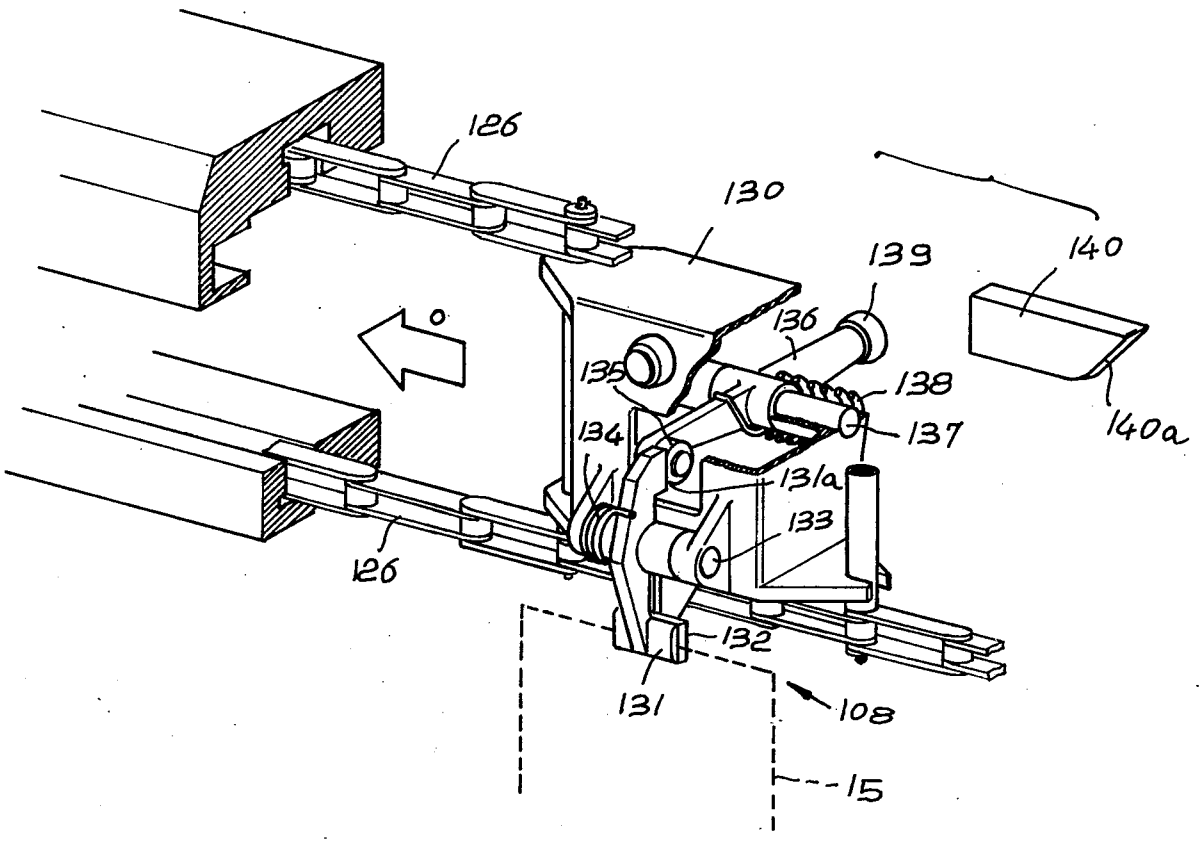
FIG. 12 is a perspective view of a gripper in a final or terminal conveyor of the machine.

The welding set or assembly 8, located downstream of the metering device 7, (FIG. 1 and 9) comprises in a known manner a heated channel 124 wherethrough the mouths 215 (FIG. 11) of the envelopes are caused to pass, the envelope mouths having been previously stretched by the grippers 79 which entrain the envelopes. After the channel 124, there are provided one or more rotating roller pairs 125, which are kept cool and compress the mouths, previously heated, of the envelopes moving past them, thereby a sealed seam closure is obtained. The final conveyor 9 (FIGS. 1, 9 and 12) also comprises a pair of chains 126 which are driven by the wheel 127 and run around the idlers 128 and 129 and move in the direction of arrow 0 at a speed equal to that of the chains 74. Portions of chains 74 downstream of the roller pairs 125 are accompanied by portions of chains 126 running between the wheels 126' and 127. On the chains 126 frames 130 of the grippers 108 are mounted at regular pitch distances, the movable jaw 131 of the grippers having a stable closed position against the related fixed jaw 132 as well as a stable open position. The stable equilibrium positions are obtained through an action of forces similar to that described in respect of grippers 53. The jaw 131 is journaled on the frame 130 by means of a pivot pin 133 and is urged toward its opened position by the torque spring 134. When jaw 131 is closed, onto the mating edge 131*a* of an arm of the jaw 131 abuts a roller 135 of a rocker 136, which is journaled by means of the pivot pin 137 on the frame. The return to the open position is effected in cooperation with the torque spring 138. To close the gripper, another roller 139 of the rocket 136 engages with the active edge 140*a* of the cam 140, which is arranged stationary at the exit of the chain 126 from the wheel 126'. A stationary cam not shown located next to the entry of chain 126 into the wheel 128, causes the gripper 131 to open, the cam engaging the roller 139 from below. The grippers 108 thus pick up the filled and sealed envelopes from the gripper pairs 79, by clamping the envelopes at the top or at the center. They are enabled to release the envelopes in any desired manner, for example by releasing them with a vertical or horizontal orientation and placing them onto a belt conveyor, either of the smooth or bucket type. FIG. 1 shows generally the releasing of the envelopes onto a smooth belt conveyor 141, after the envelopes have been arranged horizontal by means of a stationary screw or helix 142, thereby the envelopes have their bottoms and mouths respectively facing outwardly and inwardly with respect to the conveyor 9.

The invention as such fully achieves the objects aimed at. Furthermore, it is susceptible to many modifications and variations thereof, all of which fall within the scope of the invention as claimed herein, the various details being replaceable with other technically equivalent elements, and the dimensions, shapes and materials being such to suit particular requirements of use.

We claim:

1. A machine for manufacturing, filling and conveying flat envelopes obtained from a heat sealable sheet material, characterized in that it comprises, a first closed loop conveyor having an envelope accepting path portion and an envelope transferring path portion, a second closed loop conveyor having an envelope receiving path portion, an envelope processing path portion and an envelope transposing path portion, said envelope receiving path portion of said second conveyor being arranged in side by side relationship with said envelope transferring path portion of said first conveyor, said first and second conveyors having drive means imparting a continuous motion of constant speed thereto, said envelope receiving path portion of said first conveyor having a substantially greater extension than that of said envelope transferring path portion, a plurality of envelope forming and delivering sets arranged along said envelope accepting path portion of said first conveyor and in spaced relationship to each other and adapted selectively to deliver open envelopes at said first conveyor along said envelope receiving path portion thereof, said first conveyor having first gripper means carried thereon and arranged therealong in spaced relationship to each other, first cam means arranged in preestablished positions along said first conveyor for controlling the gripping and releasing action of said first gripper means in respect of said envelopes while moving past said first cam means, thereby to grip one envelope at a time when a first gripper means is carried by said first conveyor past one said envelope forming set, second gripper means on said second conveyor and arranged therealong in spaced relationship to each other, second stationary cam means arranged around said second conveyor means to control the gripping and releasing action of said second gripper means thereby to cause each said second gripper means to grip one said envelopes at a time when said second gripper means are carried by said second conveyor along said envelope receiving path portion thereof past said envelope transferring path portion of said first conveyor, said second gripper means having a pair of gripper arms mounted on said second conveyor for oscillation about respective axes parallel to each other, thereby to allow said gripper arms to approach and move away from each other when said arms are oscillated, third stationary cam means arranged around said second conveyor for oscillating said gripper arms thereby to maintain said envelopes gripped by said second gripper means in stretched condition when said arms are oscillated in a position at a distance away from each other and alternatively in a position of smaller distance from each other, in which they partially crumple up laterally the gripped envelopes whereby the opening thereof is spread transversely, further conveyor means having a path portion thereof arranged near and coextensive with part of said envelope processing path portion of said second conveyor, said further conveyor means having mounted thereon devices for further spreading the envelopes while the latter are carried by said second conveyor along said part of envelope processing path portion thereof in which said third cam means maintain said gripper arms in said position of smaller distance thereof and in which the envelope opening is transversely spread, metering devices downstream of said further conveyor means for filling with produce, the opened envelopes, a welding device close to a length of said envelope processing path portion of said second conveyor downstream of said metering devices, along said length of said processing path portion of said second conveyor means, said third stationary cam means maintaining said gripper arms in a position of maximum distance in which said envelopes, are stretched allowing thereby the opening of said envelopes to be closed and sealed by said welding device while the envelopes are conveyed past said welding device, said second cam means causing said second gripper means to release said envelopes while said envelopes are conveyed along said envelope transposing path portion of said second conveyor, thereby allowing said envelopes to be transferred for further handling thereof.

2. A machine according to claim 1, wherein said envelope forming and delivering set comprises means for supplying to said first conveyor upwardly open flattened envelopes cut from a heat sealable web folded lengthwise to form a flattened V-shape with the folded end facing downwards and the open end facing upwards, and provided with vertical sealed seams spaced longitudinally at regular distances from one another, characterized in that said means for supplying to said first conveyor the upwardly open flattened envelopes comprises a first pair of intermittently operated feed rollers and at a distance therefrom a second pair of intermittently operated positioning and transferring rollers and scissors arranged between said feed roller pair and said positioning and transferring roller pair and adapted to cut said web along said seams when said roller pairs are stopped and hold in position for cutting the web portion situated therebetween, and after said positioning and transferring roller pair, a delivery roller pair for delivering the envelopes cut off said web to said first gripper means, said delivery roller pair having guide means cooperating therewith for guiding said envelopes towards said first gripper means.

3. A machine according to claim 2, characterized in that it comprises a driving shaft for continuously driving said first conveyor with constant speed, first transmission means for converting the continuous driving motion from said driving shaft into an intermittent rotatory motion and for transmitting it to said pair of positioning and transferring rollers and second transmission means for transmitting a continuous driving motion from said driving shaft to said delivery roller pair, said second transmission means having a selected transmission ratio imparting to said delivery roller pair a peripheral speed equal to the speed of advancement of said first conveyor, said first transmission means having a selected transmission ratio imparting to said means for supplying envelopes to said first conveyor a working speed inversally proportional to the number of said envelope supplying means for said first conveyor thereby to supply to said conveyor at all times a constant number of envelopes.

4. A machine according to claim 3, characterized in that said first transmission means have a storage programmer controlled clutch activating and disactivating upon command the operation of said envelope supplying means.

5. A machine according to claim 1, characterized in that said first cam means comprise first selectively controlled cam members arranged near said envelope accepting path portion in proximity of each said envelope forming and delivering sets and a first stationary cam member near said envelope transferring path portion, said first selectively controlled cam members being displaceable into an operative position in which they cause the closing of said first gripper means passing past said first selectively controlled cam members and are displaceable also into an inoperative position in which they leave said first gripper means passing nearby to remain unaffected when the respective envelope forming and delivering set is disactivated, said selectively controlled cam members being selectively controlled from a respective envelope forming and delivering set.

6. A machine according to claim 1, characterized in that said first gripper means have each a fixed jaw and a movable jaw, the movable jaw being bistable in the open and closed position, said grippers having a gripping nip defined by said jaws facing upstream of the feed direction of said first conveyor.

7. A machine according to claim 1, characterized in that said devices for further spreading the envelopes comprise on said further conveyor means at least one vertically reciprocating punch member above said envelope processing path portion of said second conveyor and arranged to penetrate into the body of one envelope at a time through the open end thereof thereby to spread also said envelope body, a pair of belts of closed loop configuration above said envelope processing path portion, said belts having mutually facing strand portions coextensive with part of said envelope processing path portion and opposite suction means on said belts for upper end wall portions of upwardly open envelopes passing thereby to further spread open said upper end thereof, said belt pair being arranged partially upstream of said punch carrying conveyor means and partially coextensive therewith, said belts of said pair of belts slightly diverging from one another in the downstream direction of said second conveyor.

8. A machine according to claim 1, further comprising a transferring conveyor for transferring the envelopes for further handling thereof and having a path portion thereof coextensive with a final portion of said envelope processing path portion of said second conveyor downstream of said welding device, said transferring conveyor having transfer grippers picking up the filled and sealed envelopes from said second gripper means and transferring them to an output station.

* * * * *